United States Patent [19]

Linder

[11] Patent Number: 4,558,476

[45] Date of Patent: Dec. 17, 1985

[54] FLOTATION TYPE APPARATUS AND METHOD FOR SUPPORTING A LOAD

[76] Inventor: Philip C. Linder, 7454 Telegraph Rd., Montebello, Calif. 90640

[21] Appl. No.: 540,639

[22] Filed: Oct. 11, 1983

[51] Int. Cl.[4] ..... A47C 27/08; A47C 27/18

[52] U.S. Cl. ..... 5/450; 5/451; 5/455

[58] Field of Search ..... 5/441, 454, 456, 450, 5/451, 455, 449, 453

[56] References Cited

U.S. PATENT DOCUMENTS

| | | | |
|---|---|---|---|
| 3,600,726 | 8/1971 | Albert | 5/450 |
| 4,073,021 | 2/1978 | Carlisle | 5/450 |
| 4,192,031 | 3/1980 | Fogel | 5/455 |
| 4,245,361 | 1/1981 | Evanson | 5/450 |
| 4,296,510 | 10/1981 | Phillips | 5/450 |
| 4,310,936 | 1/1982 | Benjamin | 5/455 |
| 4,345,348 | 8/1982 | Hall | 5/450 |

FOREIGN PATENT DOCUMENTS

| | | | |
|---|---|---|---|
| 2082907 | 11/1979 | United Kingdom | 5/455 |

OTHER PUBLICATIONS

Brochure by Somma, Copyright 1981.

Somma Advertisement Appearing in Daily News T.V. Weekly, Mar. 13, 1983.

*Primary Examiner*—Kenneth J. Dorner

*Assistant Examiner*—Vinh Luong

*Attorney, Agent, or Firm*—Poms, Smith, Lande & Rose

[57] ABSTRACT

A flotation type apparatus used to support loads is disclosed, as well as a method for supporting a load with a flotation apparatus. The basic configuration of the apparatus is comprised of three major components, namely, a fluid filled envelope, a resilient material within said envelope, and a gas chamber located below the resilient material and within said envelope. One or more loads are placed upon the upper surface of the fluid filled envelope and are supported by a combination of the forces exerted by the liquid, the resilient material and the gas. The pressures of the liquid and gas may both be varied to alter the supportive force experienced at the surface of the apparatus. The gas chamber may be divided into a plurality of chambers, the pressure in each being individually adjustable to vary the supportive forces felt over the surface of the flotation apparatus.

7 Claims, 7 Drawing Figures

FLOTATION TYPE APPARATUS AND METHOD FOR SUPPORTING A LOAD

FIELD OF THE INVENTION

This invention relates in general to a flotation apparatus and method for supporting loads, and more particularly to a flotation apparatus and method utilizing a chamber filled with liquid, a chamber or chambers filled with gas located within the liquid chamber, and a resilient material such as foam also located within the liquid chamber, which act together to provide the supportive forces.

BACKGROUND OF THE INVENTION

Flotation apparatus for supporting loads are currently in wide use, and are commonly used as beds for human beings. The most common type of water bed is essentially a vinyl envelope filled with water and placed within a frame. This basic design has many disadvantages, one of which is its great weight due to the large volume of water necessary to fill the envelope to a depth sufficient for comfortably supporting the weight of one or more human being. Such a device or mattress must hold fluid approximately nine inches deep and weighs approximately forty pounds per square foot exclusive of the base and frame which must be used in conjunction with it. The frame is necessary because without it the sides of the envelope will assume a rounded shape reducing the amount of support available near the edges, and allowing a user to roll off the curve.

This type of mattress has a number of disadvantages, not the least of which is the difficulty of using standard bedding such as sheets and mattress covers. Fitted sheets for example, cannot be placed around the corners of the envelope because of its weight and size. Non-fitted sheets cannot be tucked under the heavy envelope, and therefore have a tendency to slide on the surface of the mattress.

Another major disadvantage with this type of construction is that waves are created as movement occurs on the mattress, and these waves are reflected by the walls of the rigid frame, creating nodes which can be quite severe and which continue reflecting themselves throughout the mattress for a considerable length of time.

Furthermore, and most importantly, such a mattress is not capable of being easily adjusted to alter the supportive force provided. If the water pressure is raised in an attempt to increase the firmness of the mattress, then the therapeutic advantages of the water are lost and comfort is decreased because the body no longer floats on the liquid, but rather is supported by tension in the envelope.

These types of mattresses have a short life span because the forces exerted at the seams by the substantial amount of water contained in the envelope cause rupture and leakage.

In order to avoid some of these disadvantages, a number of alternative designs have been developed over the years. In order to reduce the wave action within the mattress, baffles have been added to slow the movement of the wave forces. However, because the baffles are thin and essentially non-compressible, the wave forces are transmitted through the baffles from one chamber to the next, and thus have only a small effect on the wave action.

Another design includes the use of air chambers under the envelope of water. The air chambers, because they provide a supportive force of their own, allow a reduction of the depth of water required. Consequently, some of the wave action is reduced and the firmness of the mattress can be more easily modified by changing the air pressure in the air chamber. However, the balance of the disadvantages as discussed above are not eliminated.

Another alternative design is to use a resilient foam slab under or in the water filled envelope in place of the air chamber. However, such a mattress is not adjustable by the user to change the supportive force.

Accordingly, the principal objects of the present invention are to provide a flotation apparatus which requires much less liquid than the present devices, which can be used with standard bedding, and, most importantly, which is easily adjustable to suit the needs of the user while providing optimum buoyant support over its entire surface area.

SUMMARY OF THE INVENTION

In a broad aspect of the invention, a flotation apparatus for exerting a supportive force is provided with means for confining a liquid, means for confining a gas, and a resilient material, all of which in conjunction with one another exert forces which combine to support one or more loads placed upon the apparatus.

Stated more particularly, the load is carried on the upper surface of means for confining a liquid at adjustable pressure. The pressure may be adjusted to vary the forces supporting said load. A resilient material is placed within said means for confining a liquid, and in conjunction with the liquid supports the load or loads. Acting in conjunction with the liquid and resilient material, are means for confining a liquid, which in conjunction with the liquid and the resilient material supports the load or loads. The pressure in the gas may be adjusted to vary its supportive force.

In accordance with another aspect of the invention, positioning means are provided to maintain the resilient material in a pre-determined position within the liquid.

In another aspect of the invention, a rigid material is placed on the upper surface of the means for confining a gas to provide rigidity.

In a further aspect of the invention, means are included within the means for confining a gas which restrict the flow of said gas to minimize the shifting of the gas as a load is placed or moved upon the flotation apparatus.

A plurality of chambers may be included in the means for confining a gas, each individually connected to a means to adjust pressure, for varying the supportive forces of each chamber, and consequently varying the supportive forces over the surface of the flotation apparatus.

In a further aspect of the invention, the resilient material is liquid absorbent for modifying its supportive force, and for altering its buoyancy characteristics.

Other objects, features, and advantages of the present invention will become apparent to those skilled in the art, from a consideration of the following detailed description of a preferred embodiment and the accompanying drawings.

DETAILED DESCRIPTION

A preferred embodiment of a flotation type load support apparatus in various configurations is shown in FIGS. 1-7. The means for confining a liquid is shown as a fluid tight vinyl envelope 2 which completely encloses the apparatus on all sides. The liquid 3 is allowed to move freely within the envelope, except in the space taken up by the other components to be discussed below. Liquid 3 is introduced into the vinyl envelope 2 by liquid valve 4 which also serves as a means for adjusting pressure in the liquid 3. In the most common use for this invention, namely as a mattress to support human beings, the liquid is water. As the amount of liquid 3 is increased through the liquid valve 4, the supportive force exerted by the liquid increases. In this way, users of the invention may adjust the apparatus for comfort.

Figure 1:
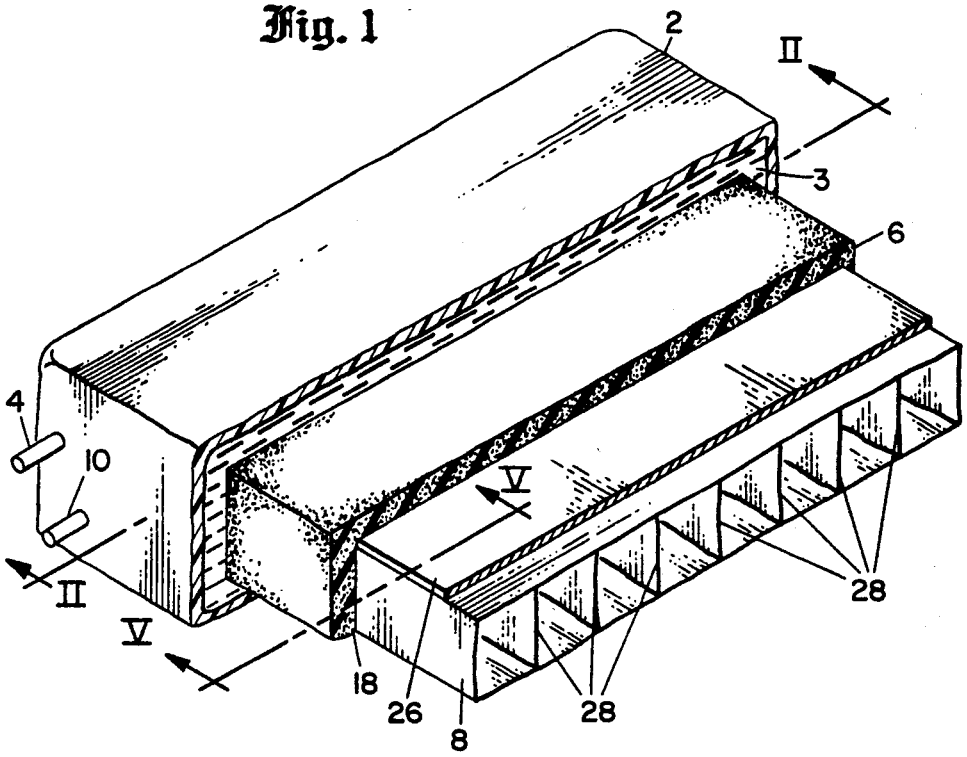
FIG. 1 is a perspective view of a flotation apparatus showing its major components.

Positioned inside the vinyl envelope 2 is a resilient material such as an elastomeric foam 6 which can clearly be seen in the perspective view of FIG. 1. The foam 6 is moderately resilient, and provides its own supportive force which can assist in supporting the load positioned on the upper surface of the vinyl envelope 2. A cavity is formed or cut into the foam 6 creating a cavity into which means for confining a gas are placed. In the preferred embodiment, the means for confining a gas is shown as bag 8. Pressure in the bag 8 exerts forces which combine with the forces of the foam 6 and the liquid 3 to exert a combined upward supportive force which maintains the load in position. For use as a mattress, the bag 8 would be filled with air introduced through one or more gas valves 10 which also serve as means for adjusting the pressure of the gas in bag 8.

Figure 2:
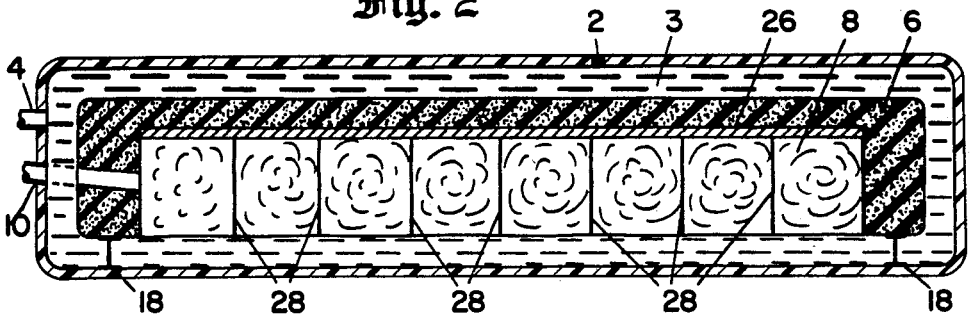
FIG. 2 is a cross-sectional view of the present invention along a plane II—II of FIG. 1, which is a plane perpendicular to the longitudinal center line of the apparatus.

As can be clearly seen in FIG. 2, the relative proportion of water in the flotation apparatus is small. This reduces the weight of the apparatus from about forty pounds per square foot if the vinyl envelope 2 were to be entirely filled with water, to approximately fifteen to twenty-five pounds per square foot, depending on size, as in the apparatus depicted in FIG. 3. FIG. 2 is a cross-sectional view along a plane II—II of FIG. 1, which is a plane perpendicular to the longitudinal centerline 11 of the apparatus.

This use of these three major components comprising the vinyl envelope 2, the foam 6 and the bag 8, has several important advantages over the prior art. This combination of the foam 6 and the bag 8 inside the vinyl envelope 2, reduces the need for adding a large amount of water into the vinyl envelope 2, thereby reducing the stress on the vinyl envelope caused by the force of the water.

A major disadvantage to present water mattress designs is their weight. It is very difficult to lift the edges of the envelope 2 so that the bedding can be tucked under the envelope 2 to secure the bedding in place, or in the case of fitted bedding, to secure the elasticized corners under the corresponding corners of the envelope 2. The design of the present invention facilitates the use of fitted or unfitted bedding for a number of reasons. First, the weight of the apparatus is approximately 35% to 40% of the weight of an envelope entirely filled with liquid. This allows the lifting of the edges so that the bedding may be securely tucked under the vinyl envelope 2. Second, the thickness of the present invention may be much less than the required thickness of the envelope of presently available water mattresses. An envelope 2 entirely filled with liquid 3 must be approximately nine inches deep in order to comfortably support a human being using the apparatus as a mattress. Because the present invention is comprised of three supportive elements, namely the liquid 3, the foam 6, and the gas within bag 8, the thickness of the apparatus may be reduced to as little as five inches. Because bedding is designed for mattresses constructed of springs or foam approximately six inches thick, standard bedding can be used on the present invention, where it could not be used on former configurations of flotation mattresses. This can result in a considerable cost savings to the user.

Another advantage to using less water is that the forces on the envelope 2 caused by the weight of the liquid are considerably reduced, extending the life of the seams of the envelope.

Figure 5:
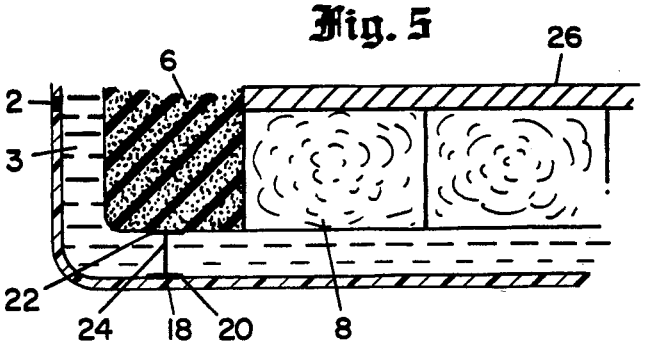
FIG. 5 is a section view taken along the plane V—V of FIG. 1.

In the preferred embodiment, positioning means or straps 18 are added to retain the foam 6 and bag 8 in a predetermined position within the vinyl envelope 2, while also allowing a layer of liquid between the bottom of the bag 8 and the vinyl envelope 2. Because of the buoyancy of the gas within the bag 8, both the foam 6 and the bag 8 tend to rise within the liquid filled envelope 2. the straps 18 restrain the foam 6 and bag 8 to allow a layer of liquid 3 to be maintained between the top of the foam layer 6 and the vinyl envelope 2. The straps 18 also prevent the foam 6 and bag 8 from moving excessively in a horizontal plane. The straps 18 are flexible, and allow a modicum of movement so that the apparatus may interact with movements of the load. FIG. 5 shows a construction detail and more clearly depicts a strap 18. In the preferred embodiment, the strap 18 comprises a lower attachment or flange 20 and an upper attachment or flange 22. The connecting web 24 is pliable and can be constructed out of an elastomeric material or vinyl similar to the envelope 2. Most commonly, the lower attachment 20 is bonded to the corresponding inside surface of the envelope 2, and the upper attachment 22 is bonded to the corresponding lower surface of the foam 6. Alternatively, upper attachment 22 may be omitted and web 24 may be extended into a slit in the foam 6 and bonded therein. One strap 18 is placed at each corner of the foam 6, but a different number may be used to meet the requirements of alternative materials or fabrication techniques.

Another major advantage to the use of the foam 6 and bag 8 within the vinyl envelope 2 is the almost complete elimination of wave movement within the apparatus. Because only a relatively small amount of liquid 3 is used within the apparatus, there is very little tendency for waves to develop. The pliable surface of the foam 6 and bag 8 also serve to dampen wave motion, and node formation is minimized.

In the preferred embodiment of the invention, a rigid means 26 is added between the foam 6 and the bag 8 to provide rigidity to the system and to prevent the foam 6 from rising upwardly constricting the space for liquid 3 near the center of the apparatus. The rigid means 26 need not be perfectly rigid but may flex to accommodate movement in the load and to provide comfort to a human user. The rigid means 26 is preferably constructed of a thermoplastic or thermosetting polymer of high molecular weight, but may be of any other substance providing the necessary amount of rigidity.

Figure 6:
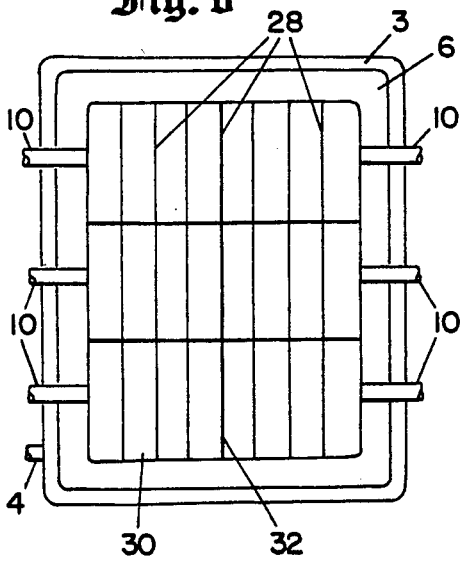
FIG. 6 is a section view taken along plane VI—VI of FIG. 3 showing means for confining a gas divided into six separately adjustable chambers.

The bag 8 includes means for restricting the flow of the gas within the bag 8, and in the preferred embodiment comprises baffles 28. The baffles 28 restrict the flow of gas from one portion of the bag 8 to other portions to prevent the gas from shifting as the load is placed upon the flotation apparatus, and as it moves about on its surface. In FIG. 6, the baffles 28 are shown extending longitudinally throughout the bag 8. In addition, baffles may be added running transversely through the bag 8 to restrict gas flow in all directions.

Figure 7:
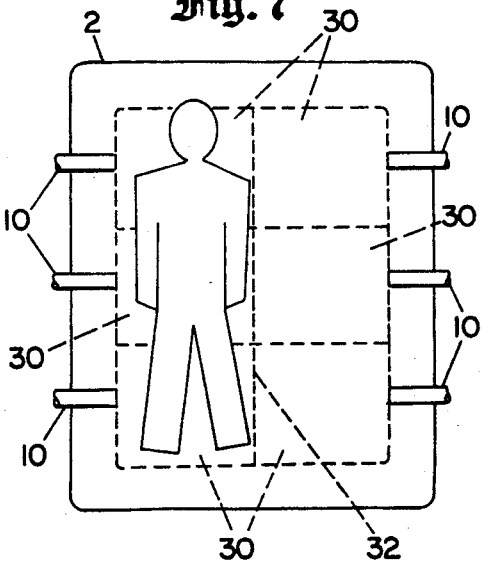
FIG. 7 is a top view of the apparatus depicted in FIG. 6 showing six individually adjustable chambers within the means for confining a gas, and a human being in the approximate position of normal use. Some details are omitted for clarity.

In another embodiment of the present invention, chambers 30 may be added. These chambers are most clearly seen in FIGS. 6 and 7. The details of the baffles 28 have been omitted in FIG. 7 to clearly show the outlines of the chambers 30. Each of the chambers 30 can be individually adjusted by using the gas valves 10. If three chambers are used, then one chamber is located below the head and shoulders of a human user, the second chamber is located below his lower back, buttocks and upper thighs, and the third chamber is located under his lower legs. In this way, the gas pressure within each chamber 30 may be adjusted through a gas valve 10, and the flotation apparatus may be customized to the preferences of any user. FIGS. 6 and 7 show a center divider 32 which divides the bag 8 longitudinally down its center. This divides each side of the flotation apparatus into at least one or as many as three or more individual chambers 30. In this way, assuming that two humans are using the flotation apparatus, each human may adjust his or her side to meet his or her comfort requirements. Any number of chambers 30 may be used in practicing this invention.

In addition to making adjustments to the gas pressure, the users may adjust the pressure of the liquid 3 by means of the liquid valve 4. In this way, the supportive forces of the liquid may be adjusted in conjunction with the supportive forces of the gas by way of gas valves 10.

Figure 3:
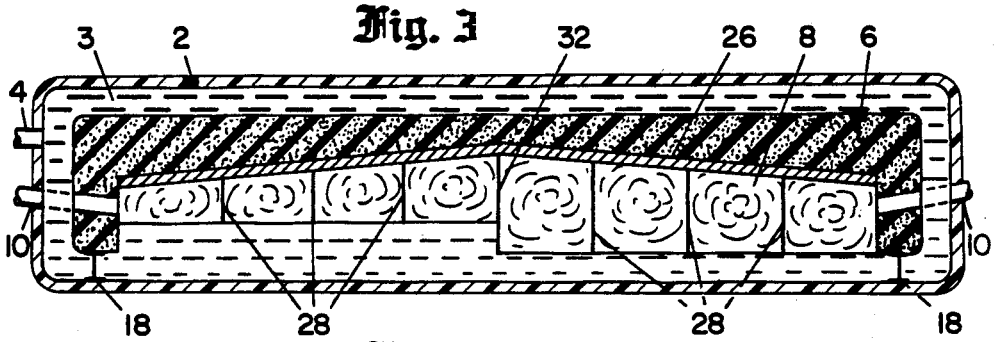
FIG. 3 is a cross-sectional view taken along a plane perpendicular to the longitudinal center line of a modified version of the apparatus showing the means for confining a gas divided into chambers which are separately inflatable and adjustable.
Figure 4:
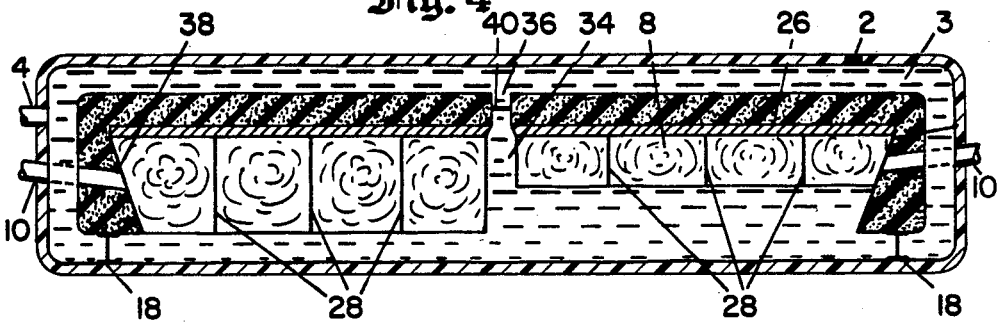
FIG. 4 is a cross-sectional view taken along a plane perpendicular to the longitudinal center line of the apparatus showing a modification which allows liquid to fill a space between the left and right side chambers of the means for confining gas.

FIGS. 3 and 4 show the effect of adjustments in the pressure of the gas in bag 8. In FIG. 3, pressure in the left chamber was reduced through valve 10. This allowed the bag 8 to be compressed, and allowed the liquid 3 to enter the area previously occupied by the fully inflated bag 8 at the bottom. The effect of this is to make the surface of the envelope 2 directly above the chamber feel more buoyant and less stiff than the surface over a fully inflated bag 8 as is depicted on the right side of FIG. 3.

FIG. 4 shows a liquid column 34 located between the left and right chambers of the bag 8. In this alternative of the present invention, the column 34 serves to define the interface between the left and right chambers 30, and may be preferred by some users of the flotation apparatus. FIG. 4 shows another construction alternative which is inclined wall 38. The inclination 38 allows the addition of foam 6 near the bottom of the apparatus to minimize the weight increase resulting from a decrease in gas pressure in a chamber 30 and the consequent increase in the volume of water under said chamber.

In order to keep the left and right portions of the foam and chambers in the embodiment in FIG. 4 in proper alignment to one another, one or more second position means or straps 40 are used. Placement and number of the second positioning means 40 is dependent upon the size of the flotation apparatus and the interior construction selected. Clearly, not every embodiment of the present invention will require straps 18 and 40, and depending upon dimensions, materials, and changes to the interior construction, straps 18 and 40 may not be required at all.

In another embodiment of the present invention, the resilient material or foam 6 may be made liquid absorbent for modifying its supportive force and its buoyancy. The effect of using such material is to increase the feeling of buoyancy experienced by a user of the apparatus.

It is to be understood that the disclosed apparatus is merely illustrative of the principles of the present invention which could be implemented by other types of structures constructed of different materials. For example, natural rubbers could be used in place of artificial elastomeric compounds, and the resilient material 5, instead of being a foam, could be a pliable thermoplastic. Accordingly, the scope of the present invention is to be determined in accordance with the appended claims.

What is claimed is:

1. A flotation apparatus for exerting a supportive force to support one or more loads comprising:

means for confining a liquid at adjustable pressure having an upper surface upon which said load or loads may be placed;

means for adjusting said pressure of said liquid so that the forces supporting said load may be varied;

a resilient material located within said means for confining said liquid for supporting said load in conjunction with said liquid;

means for confining a gas at adjustable pressure located within said means for confining said liquid for supporting said load in conjunction with said resilient material and said liquid;

means for adjusting the pressure of said gas to further vary said forces supporting said load; and rigid means located between said resilient material and said means for confining a gas for providing rigidity to the means for confining a gas.

2. The flotation apparatus of claim 1 further comprising:

positioning means for positioning said resilient material within said means for confining said liquid to maintain said resilient material in a predetermined position for adequately supporting the load.

3. The flotation apparatus of claim 1 wherein said means for confining a gas include means for restricting the flow of said gas from one portion of said means for confining a gas to other portions thereof to restrict the shifting of said gas as said load is placed upon or moved over the surface of said flotation apparatus.

4. The flotation apparatus of claim 1 wherein said resilient material is liquid absorbent for modifying the supported forces of said resilient material.

5. The flotation apparatus of claim 1 wherein said means for containing a gas include a plurality of chambers, each of which is connected to said means for adjusting the pressure of said gas for varying the pressure in each chamber independently, and consequently varying the forces supporting said load in different portions of said flotation apparatus.

6. The flotation apparatus of claim 5 wherein said chambers are configured into at least three chambers each under approximately one third of the upper surface area of the flotation apparatus for varying the supportive forces of said upper surface areas.

7. The flotation apparatus of claim 5 wherein said chambers are configured into at least six chambers, each under approximately one sixth of the upper surface area of the flotation apparatus for varying the supportive forces of said upper surface areas.

* * * * *